US005150161A

United States Patent [19]

Bujese

[11] Patent Number: 5,150,161

[45] Date of Patent: Sep. 22, 1992

[54] COLOR PRINTING APPARATUS AND PROCESS USING FIRST AND SECOND TRANSFER SURFACES

[75] Inventor: David P. Bujese, Southington, Conn.

[73] Assignee: Olin Corporation, Cheshire, Conn.

[21] Appl. No.: 808,251

[22] Filed: Nov. 14, 1991

Related U.S. Application Data

[63] Continuation of Ser. No. 682,496, Apr. 9, 1991, abandoned.

[51] Int. Cl.[5] ..... G03G 15/01; G03G 15/10; G03G 15/16

[52] U.S. Cl. ..... 355/256; 355/271; 355/279; 355/280; 355/326; 430/126

[58] Field of Search ..... 355/256, 271–273, 355/279, 280, 326, 327, 281; 430/126, 47

[56] References Cited

U.S. PATENT DOCUMENTS

| | | | |
|---|---|---|---|
| 2,990,278 | 6/1961 | Carlson | 432/124 |
| 3,893,761 | 7/1975 | Buchan et al. | 355/272 |
| 4,348,098 | 9/1982 | Koizumi | 355/274 |
| 4,690,539 | 9/1987 | Radulski et al. | 355/272 |
| 4,708,460 | 11/1987 | Langdon | 355/271 |
| 4,743,939 | 5/1988 | Dulmage et al. | 355/274 |
| 4,935,788 | 6/1990 | Fantuzzo et al. | 355/326 |
| 5,028,964 | 7/1991 | Landa et al. | 355/256 X |

FOREIGN PATENT DOCUMENTS

| | | | |
|---|---|---|---|
| 62-240987 | 10/1987 | Japan | 355/271 |

*Primary Examiner*—Joan H. Pendegrass
*Attorney, Agent, or Firm*—Ralph D'Alessandro

[57] ABSTRACT

Apparatus and a method of using the apparatus to transfer a liquid toned image from a first master surface to a final receiving surface via two intermediate transfer surfaces is disclosed. The liquid developed image is transferred three times, the initial transfer from the master surface being a non-contact transfer and the next two transfers being contact transfers. The second intermediate transfer surface is tacky or adhesive to remove all of the dried toner image from the first intermediate transfer surface.

44 Claims, 2 Drawing Sheets

COLOR PRINTING APPARATUS AND PROCESS USING FIRST AND SECOND TRANSFER SURFACES

This application is a continuation of application Ser. No. 07/682,496, filed Apr. 9, 1991, now abandoned.

BACKGROUND OF THE INVENTION

This invention relates generally to multiple color printing systems, and more particularly to the apparatus and method employed to form a full color image with a liquid toner on an intermediate surface and the transfer from that surface to a final receiving surface.

Full color copying has been achieved by using a variety of multiple color electrophotographic printing devices. Electrophotographic printing as a process employs the common feature of using a photoconductive surface that is charged to a substantially uniform potential. The photoconductive surface is then imagewise exposed to have formed thereon an electrostatic latent image corresponding to the areas of the original master that is desired to be reproduced. The electrostatic latent image of charge is developed by an appropriate developer material, such as a toner in a liquid carrier or a dry powder toner, by having the toner materials brought into contact with the electrostatic latent image. The toner particles are drawn to the charged latent image and the resultant developed or toned image is then transferred from the photoconductive surface to a final copy sheet and permanently affixed thereto by fusing.

With black and white electrophotographic copying, the previously described process is performed just once. However, with the development of multiple color electrophotographic printing, the process is repeated for each color employed and thus could require the running through of three or four or more cycles. Also, the charged photoconductive surface is exposed to a filtered light image and the resulting electrostatic latent charge is then developed with toner particles corresponding in color to the subtractive primary of the filtered light image. By way of illustration, when a red filter is employed, the electrostatic latent image is developed with cyan toner particles and the cyan toned images are transferred to the copy sheet.

This type of a process is especially employed with dry powder systems and the steps are repeated for each subsequent color employed. For example, a green filtered latent image is developed with magenta toner particles and a blue filtered light image is developed with yellow toner particles. Generally, each differently colored toner powder image is transferred sequentially to a final receiving sheet in superimposed registration so that three or more powder images are transferred sequentially to the final receiving sheet. After all are transferred, the images are fused, such as by heating or pressure, or both. A major disadvantage of these prior machines is the time involved to make the multiple passes for each color. Obviously, it is critical that the superimposed powder images be accurately and precisely aligned with one another during each part of the cycle and during transfer to the copy sheet.

Other full color printing systems utilize dry powder toner with an intermediate transfer surface or member. In most cases these are rollers, but could equally as well be belts. Again, in these types of systems the successive dry powder toner images are transferred in superimposed registration from the photoconductive drum to the intermediate roller and then to the final receiving surface. Multiple photoconductor drums could also be used.

Liquid toner processes and copiers have become more popular. The liquid developer material includes a liquid carrier having toner particles dispersed therein and the liquid toner is brought into contact with the electrostatic latent image, allowing the toner particles to be deposited thereon in imagewise configuration. Once the liquid carrier toner particles have been deposited on the photoconductive surface in imagewise configuration, the image is transferred to a copy sheet either directly, or through an intermediate transfer surface.

One disadvantage of using liquid toner developers is that the copy sheet is wet with both the toner particles and the liquid carrier. It is therefore necessary to remove the liquid carrier from the copy sheet. Various drying systems have been devised to do this, either prior or subsequent to the fusing step, by vaporizing the liquid carrier. The use of an intermediate transfer surface, such as a web, belt or roller, facilitates the removal of the liquid carrier. However, this intermediate transfer surface also requires an additional transfer, which affects the quality of the transferred image. Generally, liquid images tend to smear and intermingle with one another, distorting and blurring the resulting multiple color copy. Liquid images have also been known to transfer back to the photoconductive surface from the intermediate or final surface.

A number of representative patents dealing with an intermediate transfer belt for both dry powder and liquid toner developer materials do this.

U.S. Pat. No. 2,990,278 issued Jun. 27, 1961 to Carlson discloses a method and apparatus for transferring and fusing a dry powder toner from a xerographic drum via an intermediate transfer belt to a final copy sheet.

U.S. Pat. No. 3,893,761 issued Jul. 8, 1975 to Buchan et al. discloses an apparatus with an intermediate transfer belt made from silicone rubber that transfers the toned image from a first support material via the use of pressure to a second support material, such as a final copy sheet, by the use of heat and/or pressure. A radiant heater is employed to heat the dry powder toner on the silicone belt prior to transfer.

U.S. Pat. No. 3,923,392 issued Dec. 2, 1975 to Buchan et al. discloses an apparatus with an intermediate transfer belt made from silicone elastomer which pressure transfers the dry powder image from the photoreceptor to the final transfer fusing station. A radiant heater is utilized in the intermediate transfer.

U.S. Pat. No. 4,095,866 issued Jun. 20, 1978 to Koeleman et al. discloses a photoreceptor belt, an intermediate transfer belt, and a final transfer and fusing apparatus. The first transfer station employs pressure on the intermediate transfer belt which is made of silicone rubber and heated. The image is transferred to the final receiving surface by pressure and contact.

U.S. Pat. No. 4,348,098 issued Sep. 7, 1982 to Koizumi discloses an apparatus and process alleged to be equally adaptable to a dry powder toner or liquid toner in which an intermediate transfer drum is electrically biased by corona charging to transfer the toned image thereto. Toned images are then transferred and fused to a final receiving sheet by pressure rolls.

U.S. Pat. No. 4,445,820 issued Jun. 12, 1984 to Suzuki discloses an intermediate transfer belt made from silicone or RTV rubber which receives a toned image from a photoconductive drum through light pressure. The toned image is then heated to fusion temperature on the belt and then the final receiving surface is pressed against the belt to effect transfer of the toned image.

U.S. Pat. No. 4,542,978 issued Sep. 24, 1985 to Tarumui et al. discloses a high speed transfer device that uses a photoconductor and an intermediate belt wherein transfer is accomplished by light contact between the belt and the photoconductor. The intermediate belt wraps about a large diameter heating roller and the toner image is subsequently transferred to the final receiving surface through pressure between the heating roll and the second roll.

U.S. Pat. No. 4,690,539 issued Sep. 1, 1987 to Radulski et al. discloses apparatus in which liquid toned images are transferred from a photoconductive member to a final receiving sheet via an intermediate web. The liquid carrier is removed from the intermediate web by means of a vacuum that also secures the toner particles to the intermediate web. The full color image is transferred from the intermediate transfer surface to the final receiving transfer surface at a transfer station by a corona transfer by spraying charged ions on the backside of the final receiving surface.

U.S. Pat. No. 4,708,460 issued Nov. 24, 1987 to Langdon discloses an apparatus in which the liquid image is transferred from a photoconductive member to an intermediate member positioned closely adjacent thereto but not in contact therewith. The liquid image is simultaneously transferred and fused to the final receiving sheet from the intermediate transfer member by a contact transfer.

U.S. Pat. No. 4,935,788 issued Jun. 19, 1990 to Fantuzzo et al. discloses a multiple color printing system for a liquid toner utilizing a plurality of developing stations about the photoconductor. The different color liquid images are transferred in superimposed registration to the intermediate member to form a multiple color liquid image thereon and thereafter the multiple color liquid image is transferred to the final receiving sheet and fused thereto.

In all of these prior art references, the quality of the transferred image has not been preserved, as previously explained. These problems are solved in the design of the present invention utilizing a conductive intermediate surface that is positioned adjacent to the photoconductor and a second intermediate transfer adhesive surface that receives a dried toned image from the conductive intermediate transfer surface and transfers it to the final receiving surface via pressure and heat.

SUMMARY OF THE INVENTION

It is an object of the present invent provide a transfer apparatus for color printing that employs three separate transfers to the final receiving surface.

It is another object of the present invention to provide a transfer apparatus for color printing that utilizes a liquid toned image that is transferred from a photoconductive surface to a first intermediate transfer surface and then to a second intermediate transfer surface prior to a contact transfer to the final receiving surface.

It is a feature of the present invention that the first intermediate transfer surface is conductive and has a non-oxidizable surface that is smooth and devoid of surface imperfections to which dry toner could adhere and not transfer to the tacky second intermediate surface.

It is another feature of the present invention that the first transfer from the photoconductive surface of the liquid toned image to the first intermediate transfer surface is across a liquid-filled gap.

It is still another feature of the present invention that the transferred liquid image on the first intermediate transfer surface is dried thereon prior to any subsequent transfer to the second intermediate transfer surface.

It is yet another feature of the present invention that additional colors beyond that toned color image initially transfer to the first intermediate transfer surface are developed on the photoconductive surface and transferred across the liquid-filled gap to the first intermediate transfer surface in superimposed registration thereon with each other and the initially transferred image and then dried.

It is yet another feature of the present invention that the superimposed color image that has been dried is contact transferred to a second intermediate transfer surface that has a dielectric silicone or fluorosilicone surface.

It is still another feature of the present invention that the color image is then transferred to the final receiving surface from the second intermediate transfer surface by contact between the final receiving surface and a fuser roller that can employ contact and/or heat to fuse the full color image to the final receiving surface.

It is still another feature of the present invention that the first intermediate conductive transfer surface can be either in drum or belt form.

It is yet another feature of the present invention that the second intermediate transfer surface can be in either a roller, drum, belt or a plate.

It is an advantage of the present invention that the conductive first intermediate transfer surface does not swell when brought into contact with the liquid carrier of the toner particles providing a constant gap between the photoconductive surface and the first intermediate transfer surface.

It is another advantage of the present invention that there is no apparent loss of resolution between the two transfers of the toned image after the transfer from the photoconductive surface going from the first intermediate transfer surface to the second intermediate transfer surface and then to the final receiving surface.

It is another advantage of the present invention that the highly polished and smooth surface of the first intermediate conductive transfer surface has essentially 100% of the toner image transferred to the second intermediate transfer surface by virtue of the adhesiveness or tackiness of the second intermediate transfer surface.

These and other objects, features and advantages are obtained in the transfer apparatus and method of the present invention wherein a liquid toned image is transferred from a photoconductive surface across a liquid-filled gap to a first intermediate transfer and then contact transferred to a second intermediate transfer surface that has an adhesive or tacky surface covering and a third contact transfer to the final receiving surface. The multiple color images are superimposed on the first conductive intermediate transfer surface and dried thereon prior to the contact transfer to the second intermediate transfer surface.

BRIEF DESCRIPTION OF THE DRAWINGS

The objects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
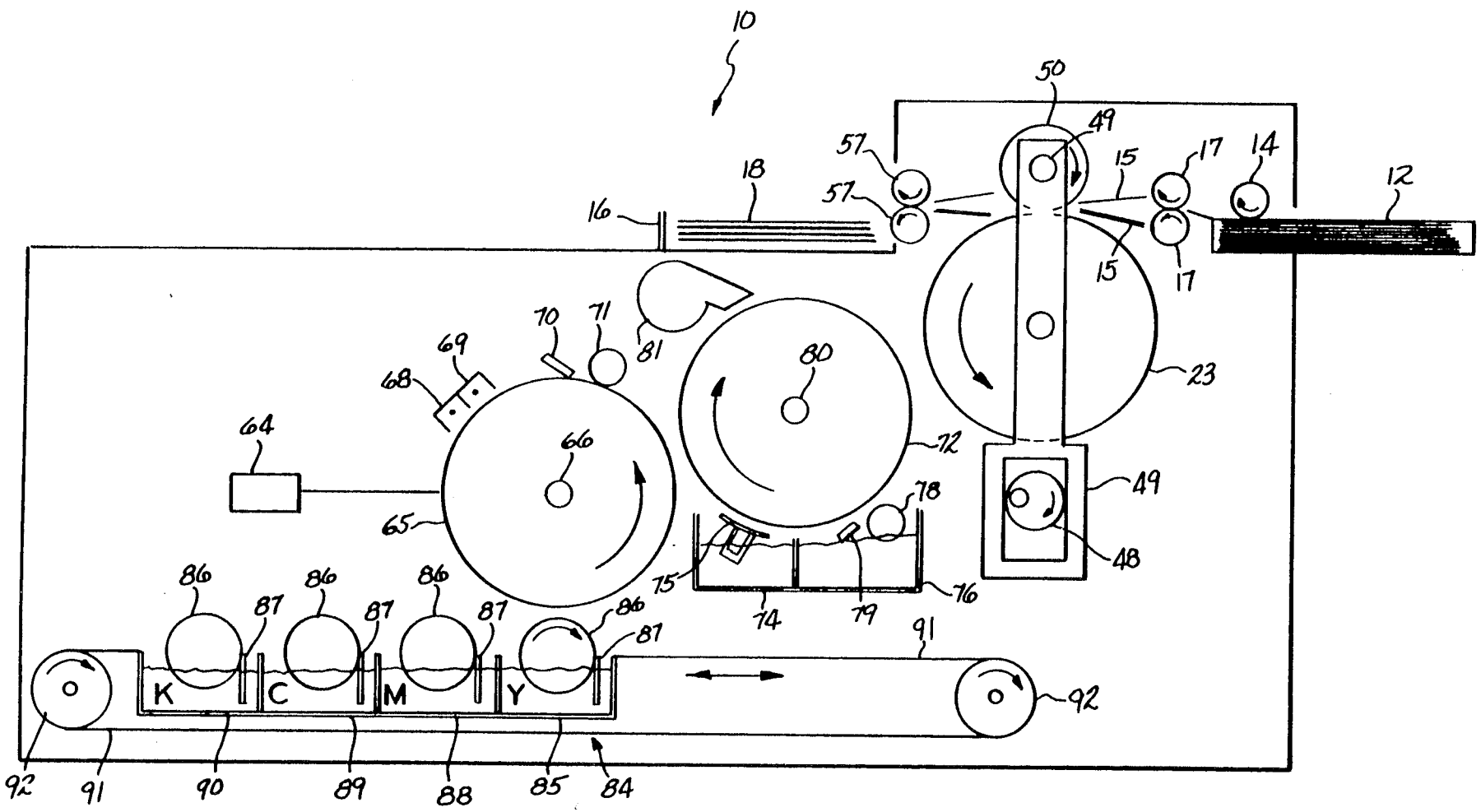
FIG. 1 is a schematic side elevational view showing an illustrative multiple color transfer apparatus incorporating the features of the present invention.

FIG. 1 shows a preferred embodiment of the printing apparatus 10 that utilizes three separate image transfers to the final receiving surface. The final receiving surfaces are printed paper sheets 18. An exposure system 64, which can be a laser or other optical imagewise exposing unit, is shown connected to a first photosensitive surface 65. The photosensitive surface 65 is a photoconductor. The photosensitive surface or drum 65 rotates about a shaft 66 that has a charging corona 68 and a discharging corona 69 to create a latent image of charge on the surface 65 and then to use the discharge corona 69 to permit reimaging of the surface. A drum wiper 70 and a reverse roller 71 are employed to remove any excess liquid toner that may be applied to the photosensitive surface 65 by the developing station 84.

Developing station, generally indicated by the numeral 84, includes a plurality of color toner modules, each comprising a wiper 87 to remove any non-transferred toner from the toner development roller 86 after transfer to the photosensitive surface 65 to permit a continuous even layer of toner to be applied to the photosensitive surface 65, which may be a drum or roller. Each individual module includes a toner development roller 86 and a wiper 87. The toner development modules are indicated generally as a yellow toner module 85, a magenta toner module 88, a cyan toner module 89 and a black toner module 90. Additional modules can be employed to obtain the desired number of colors. Each module has a toner tank to retain the liquid toner therein and through which the toner development rollers 86 pass prior to wetting the photosensitive surface 65 by contacting the toner layers on the rollers 86 with the surface 65. A bias voltage is applied to the toner development roller 86 to hold the toner on the roller. The bias voltage is less than the charge on the latent image on the photosensitive surface. The developing station 84 is advanced by means of drive sprockets 92 and chain 91 that permits the modules 85, 88, 89 and 90 to be moved in a generally horizontal direction into the operative position one at a time to develop the photosensitive surface 65 with the desired color toner. A reciprocatable yoke (not shown) is connected to the color modules which engages a pin (also not shown) on the chain 91 to permit the modules 85, 88, 89, and 90 to change direction and return to their initial starting position.

Once the photosensitive surface 65 has received the single color toner thereon, that single color toner image is transferred across the liquid-filled gap between the photosensitive surface 65 and the conductive first intermediate transfer surface 72. This transfer is described more fully in U.S. Pat. No. 4,879,184 issued Nov. 7, 1989 assigned to the assignee of the present invention and hereinafter specifically incorporated by reference in pertinent part.

Each separate color image is imagewise exposed and developed on the photosensitive surface 65 and transferred across the liquid-filled gap to the conductive first intermediate surface 72 in superimposed registration. Once all of the developed color images have been transferred and superimposed on the conductive first intermediate transfer surface 72, the images are dried by appropriate means, such as a transaxial blower 81 available from The Dayton Company, that can work cooperatively with a heating element. The dried image is then ready for transfer to the second intermediate conductive surface 23 which consists of an adhesive or tacky surface formed of silicone or fluorosilicone in a manner that will be described hereinafter.

Adjacent the conductive first intermediate transfer surface 72 is a wicking station 74 and a cleaning station 76. Wicking station 74 has a metered wicking shoe 75 that wets the surface with non-polar insulating solvent, such as that sold under the tradename ISOPAR by the Exxon Corporation. The wicking station 74 is turned on and off for wetting by a separate control. The cleaning station 76, with its cleaning roller 78 and wiper blade 79, is actuated by a cam and clutch (not shown) against the first intermediate transfer surface after the image has transferred from the conductive first intermediate transfer surface 72 to the second intermediate silicone or fluorosilicone transfer surface 23. This permits the conductive first intermediate transfer surface 72 to be cleaned and prepared for the next image to be transferred thereto.

The four or more color toner developed images are superimposed on each succeeding color image on the conductive first intermediate transfer surface 72 to form a single full color image that is dried and then transferred to the second intermediate transfer surface 23 by the activation of an eccentric cam 48 which rotates, driving fork cam follower 49, to which second intermediate transfer surface 23 is attached. This moves the second intermediate transfer surface towards and into contact with the conductive first intermediate transfer surface 72. The tacky or adhesive surface of silicone or fluorosilicone on the second intermediate transfer surface 23 removes substantially all of the dried full color image from the conductive first intermediate transfer surface 72 as the conductive first intermediate transfer surface and the second intermediate transfer surface rotate in the opposite directions. The second intermediate transfer surface 23 is pivoted about pivot point and shaft 49.

The toner image is then transferred to the print paper 12 by pressure and heat in a contact transfer by being passed between the nip formed by the heated fuser roller 50 and the second intermediate transfer surface 23.. Pressure on the fuser roller 50 is maintained by the use Of an appropriate air cylinder (not shown) to ensure the proper pressure is maintained at all times during the contact transfer.

The paper 12 is conveyed into the nip between the fuser roller 50 and the second intermediate transfer surface 23 by the paper feed roller 14, guide rollers 17 and the shield and paper guide 15. The paper is then transported in registration with each full color image on the second intermediate transfer surface 23. Each sheet of printed paper 18 is then conveyed to the printed paper storage tray 16 by guide rollers 57.

The photosensitive surface 65, the conductive first intermediate transfer surface 72 and second intermediate transfer surface must all rotate at the same surface speed, although their diameters may vary. However, the circumference of the first intermediate transfer surface must be greater than the image to be superimposed thereon.

A printing apparatus in FIG. 1 transfers all four images in superimposed registration onto the conductive first intermediate transfer surface 72. The second intermediate transfer surface 23 must be disengaged from contact with the conductive first intermediate transfer surface 72 during this operation. Once transfer is complete and the full color image is on the conductive first intermediate transfer surface 72 and is dried, the second intermediate transfer surface 23 is moved into contact therewith. However, each of the images must be generated individually in a non-continuous fashion.

Figure 2:
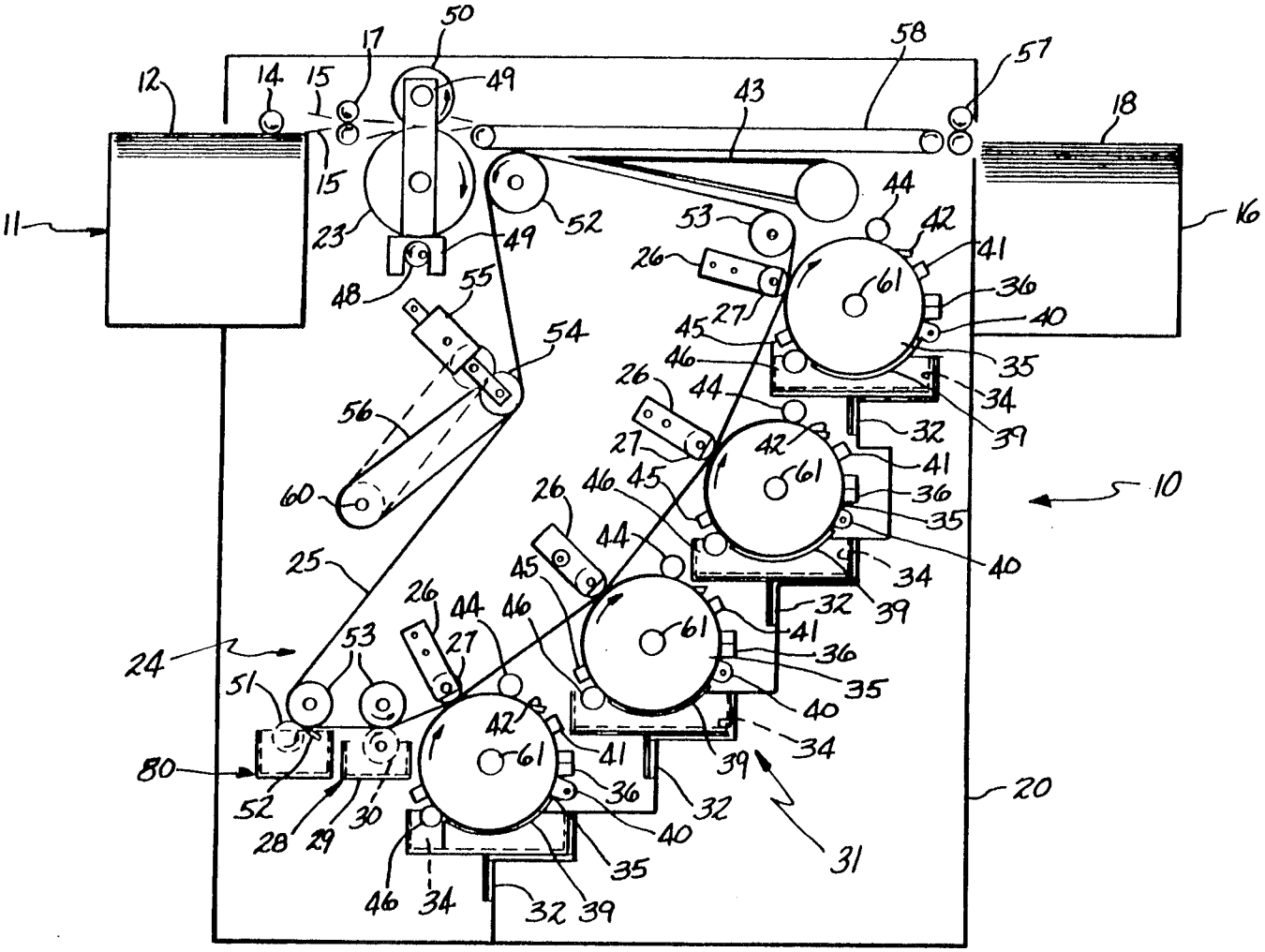
FIG. 2 is a schematic side elevational view of an alternative embodiment of the multiple color printing apparatus incorporating the features of the present invention in a conductive intermediate transfer belt.

In contrast, the printing apparatus 10 shown in FIG. 2 is a design that will permit continuous transferring of multiple color images to the conductive transfer surface or belt 25. In this embodiment which, will be described in detail hereinafter, the second intermediate transfer surface 23 can always be in contact with the conductive first intermediate transfer surface 25 during operation.

FIG. 2 shows an alternative embodiment of the color printing apparatus, indicated generally by the numeral 10, in side elevational view with a portion of the front housing broken away to reveal the transfer mechanism, which is indicated generally by the numeral 24. A housing 20 contains the functional components of the printer 10, which includes a paper feed mechanism, indicated generally by the numeral 11, that supplies the final receiving paper substrate in the form of sheets of paper 12 from a feed stack. The paper 12 is fed into the printer 10 via a paper feed roller 14 that passes the individual sheets of paper 12 beneath the paper shield and feed guide 15 and through the guide roller 17 to the interior of the printer 10 where it is fed into the nip formed by the fusing roller 50 and the second intermediate transfer surface or roller 23. Once the color image has been transferred to the paper 12 in a manner to be described in further detail hereafter, the full color toned printer paper 12 is conveyed out of the printer 10 by the printed paper vacuum transport conveyor 58. Transport 58 delivers the printed sheets through guide rollers 57 to the vertically movable printed paper support tray 16 that is moved along vertical support rails (not shown) by an appropriate electrical drive motor (also not shown) to collect the stack of printed paper sheets 18.

FIG. 2 shows the transfer mechanism 24. An essential element of this transfer mechanism 24 is the conductive first intermediate transfer surface that is shown as a belt 25. Belt 25 may be metal or a metal clad on a dimensionally stable thermoplastic film. Conductive first intermediate transfer belt 25 travels in a continuous path about guide rollers 53 and drive roller 52. Roller 52 is driven by the same motor (not shown) that rotates developing drums 35 on which are mounted either the permanent or reimageable master, which can either be a photopolymer master or a reimageable photoconductor. Belt 25 is held in constant tension by regulated air cylinder 55 and belt tensioning roller 54 that contacts belt 25 along its width.

Conductive first intermediate transfer belt 25 is preferably a laminate that is comprised of a conductive material (not shown), preferably an aluminum cladding, which is in turn appropriately fastened to an underlying supporting dielectric layer (not shown), such as a thermoplastic film, polysulfone, polyether sulfone, or polyvinyl chloride polyethermide. The belt surface must be smooth and not tacky. The dielectric layer can be any other material that is heat stable and is readily coated with a conductive material, such as aluminum or other metal foil, or can be metallized by vapor deposition, ion implantation or sputtering. Tin plated stainless steel, gold plating on, for example, brass, stainless steel or a thin oxidized protected steel could also be employed.

The aluminum cladding or the metallized layer can range in thickness from about 0.1 to about 1.5 mils, preferably from about 0.5 to about 1 mil. Where a metallized layer is employed the thickness can be subangstrom, but the controlling factor is the resistivity, which is less than 0.5 ohms/centimeter$^2$.

A metal belt of non-oxidizable material such as stainless steel can be from about 1 mil to about 30 mils thick, but is preferably about 5 to about 15 mils thick. A very thin coating of polyvinylidene fluoride of less than 1 mil and more preferably less than ¼ of a mil on a metal or metallized substrate could also be employed, as could a conductive polytetrafluoroethylene on a conductive substrate. It is to be understood that the contact surface of this first intermediate contact surface, regardless of material employed, must be very smooth to ensure good toner release during transfer to the second intermediate transfer surface 23.

The conductive metal layer (not shown) can range in thickness as previously described and can include any appropriate metal or conductive material. It is through this conductive metal layer that the transfer voltage is applied to establish the electrostatic field to cause oppositely charged toner particles to be attracted through the liquid-filled gap to the surface of the conductive metal material or cladding.

The dielectric layer (not shown) can range in size from about 3 to about 15 mils in thickness and must be heat stabilized so that the entire laminated conductive first intermediate transfer surface or belt 25 is a material that is dimensionally stable under heat and tension.

The transfer mechanism 24 includes a wicking station 28 that applies a non-polar insulating solvent to the surface of the conductive first intermediate transfer belt 25. The solvent is preferably comprised of a mixture of branched aliphatic hydrocarbons, such as those available under the tradename ISOPAR from Exxon Corporation. The solvent is held within tank 29 and has a wicking roller 30 rotatably mounted therein to apply the solvent to the belt 25. The roller 30 is partially immersed in the solvent within the tank 29 and applies an even coating to belt 25.

The plurality of color development modules, indicated generally by the numeral 31, are positioned adjacent the path of the conductive first intermediate transfer belt 25. Each module is slidably mounted for movement and ease of access and maintenance on a slide 32 that pulls out generally horizontally from the front of the printer 10. Each module 31 includes a color toner tank 34 for the colors employed. These typically are cyan, magenta, yellow and black in four color images. The individual color toners within each module 31 are pumped from their respective toner tank 34 to the development electrode 39, as seen in FIG. 2.

As each of the developing drums 35 rotate around their shafts 61, which are mounted in development support plates (not shown), the detachable masters or photoreceptor material mounted about the periphery of the drums are developed with the liquid toner by wetting. Each of the developing drums 35 within the module 31 has arrayed in counterclockwise progression around the periphery of the drum 35 after the development electrode 39 a corona charging unit 36, a discharge corona unit 41, a wiper blade 42, and a cleaning roller 44. Above the development station toner tank 34 is a depressant corona unit 45. Rotatably mounted to the toner tank 34 is a reverse roller 46 which, in conjunction with the depressant corona unit 45, insures that any excess solvent surrounding the developed color toner image on the master or the photoconductive surface of each drum 35 is removed. The color toner is suspended in a non-polar insulating solvent comprised of a mixture of branched aliphatic hydrocarbons, such as the aforementioned ISOPAR solvent.

Where a detachable photoreceptor, such as a photoconductor, is used instead of a photopolymer as the master, an exposure lamp 40 is employed and is positioned between the corona charging unit 36 and the development electrode 39. Where such a photoreceptor, for example an organic photoconductor, is employed an opaque toner mask will be used. In this instance, the background or non-imaged areas will be discharged by the exposure lamp 40.

Where a photopolymer master is used, such as those described in U.S. Pat. No. 4,879,184 issued Nov. 7, 1989 and assigned to the assignee of the present invention, the photopolymer is exposed prior to placement on the drum 35 within the printer 10 to form the latent image. The photopolymer is cross-linked only where it has been exposed. The charge from the corona charging unit 36 will remain on these cross-linked areas and will decay in the non-imaged areas which are not cross-linked and, therefore, less resistive.

The coating of the conductive intermediate transfer belt 25 and the master with the non-polar insulating solvent and the liquid toner is essential to accomplish the electrostatic transfer of the color toner developed image on each of the drums 35 to the transfer belt 25 across a liquid-filled gap. This gap is maintained between each drum and the transfer belt 25 by the gap spacer adjusters 26, which are typically cam actuated, and the transfer rollers 27 attached thereto. The transfer rollers 27 can also be used to adjust the registration of the color image between each developing drum 35 and the conductive first intermediate transfer surface 25 by adjusting the gap spacing adjusters 26. The transfer is effected by the application of an electric field via a high voltage charge continually applied to the metal conductive layer in the conductive first intermediate transfer surface or belt 25. This charge transfers the toned image on each master through the approximately 0.001 to about 0.003 inch gap between the master or photoreceptor and the belt 25 in conjunction with the use of the transfer roller 27. This transfer across the liquid-filled gap is accomplished as described in greater detail in U.S. Pat. No. 4,879,184 issued Nov. 7, 1989 and assigned to the assignee of the present invention.

After each color image is transferred to the conductive intermediate transfer belt 25 any residual toner not removed from each photoconductor surface or master is removed by cleaning roller 44 and wiper blade 42. Any charge remaining on the master or photoreceptor is erased by the high voltage AC charge from discharge corona unit 41 before the master or photoreceptor is recharged and developed for a repeat transfer in another printing cycle.

After all of the four or more color images are transferred to the conductive first intermediate transfer belt 25, carrier liquid is removed from the toner particles by an air knife or air dryer 43.

The four or more color toner developed images are superimposed on each succeeding color image on the conductive intermediate transfer surface or belt 25 to form a single full color image. The single full color image is then transferred to the second intermediate transfer surface 23 by the activation of an eccentric cam 48 which rotates, driving forked cam follower 49, to which second intermediate transfer surface 23 is attached, to move toward the conductive first intermediate transfer surface 25 until contact is made. The tacky or adhesive surface of silicone or fluorosilicone removes substantially all of the dried full color image from the conductive first intermediate transfer surface 25 as the conductive first intermediate transfer surface 25 and the second intermediate transfer surface 23 rotate in opposite directions.

The toner image is then transferred to the print paper 12 by heat and pressure in a contact transfer by being passed between the nip formed by the fuser roller 50 and the second intermediate transfer surface 23. The pressure on the fuser roller 50 is maintained by the use of the fusing roller air cylinder (not shown) to insure the proper pressure is maintained at all times during the contact transfer. Fuser roller 50 is heated to help fuse the full color image to the paper 12, in conjunction with the pressure.

The paper 12 is conveyed into the nip between the fuser roller 50 and the second intermediate transfer roller by the paper conveyor 14, guide rollers 17 and its shield and paper guide 15. The paper 12 is transported in registration with each full color image on the second intermediate transfer surface 23. Each sheet of printed paper 18 is then conveyed by the printed paper transport conveyor 58 to the printed paper support tray 16 for stacking.

Should some of the full color toner image not be completely fused to the paper 12 and remain on the conductive intermediate transfer, belt 25, it is removed by the belt cleaning station 80. Station 80 has a reverse roller 51 and a wiper blade 52 which are cammed up into engagement with the conductive first intermediate transfer surface 25 when needed.

Tensioning roller 54 is mounted to arm 56 and is driven by contact with belt 25. Arm 56 pivots about point 60. The tensioning roller 54 is maintained in contact with the conductive first intermediate transfer surface or belt 25 by means of the air cylinder 55 which functions as an actuator to adjust the tension on the belt 25, as seen by the solid and phantom lines in FIG. 2. Belt 25 is thus adjustably maintained in constant tension or may be adjusted to provide the slack to permit replacement of the conductive first intermediate transfer belt.

The diameter of each of the developing drums 35, including the thickness of the masters or the photoconductor surfaces, has been designed such that the length of the conductive first intermediate transfer surface or belt 25 is equal to the circumferences of the four developing drums 35 with the masters or photoconductors attached. This permits the seam in the conductive first intermediate transfer surface or belt 25 to be positioned in relation to an indicator which is in direct relation to the non-imaged areas on the master drums and corresponds to the attachment device on the drums 35. As the surface or belt 25 travels every fourth revolution of a drum 35, the seam on the drums 35 will align with the seam on the belt 25 since the seams on the drum 35 are indexed to align with the seam on the belt 25. This permits a plurality of full color images, in this instance four, to be continuously superimposed on the surface or length of the conductive first intermediate transfer surface or belt 25 as it travels one complete revolution or traversal about its predetermined path to accomplish high speed color printing.

It is significant to note that in either of the embodiments shown in FIGS. 1 or 2, the image formed by the toner particles is not heated to, or is maintained below, the fusing temperature of the toner particles on the conductive first intermediate transfer surface. The color toner remains opaque on the conductive first intermediate transfer surface. The temperature of the color toner is raised to or above the fusing temperature on the second intermediate transfer surface by the heated fusing roller to facilitate to the final receiving surface or paper that passes therebetween in the nip formed by the fusing roller and the second intermediate transfer surface.

While the invention has been described above with references to specific embodiments thereof, it is apparent that many changes, modifications and variations in the materials, arrangements of parts and steps can be made without departing from the inventive concept disclosed herein. For example, in employing masters on the first photosensitive surface in the present invention, any suitably electrostatically imageable surface, including a photoreceptor, may be employed. This can include a photoconductor, such as a cadmium sulfide surface with a MYLAR polyester film or a polystyrene or a polyethylene overcoating, a selenium photoconductor drum, or suitable organic photoconductors such as carbazole and carbazole derivatives, polyvinyl carbazole and anthracene. If a master with a permanent latent image is desired, the surface can be a zinc oxide or organic photoconductor developed with a toner which is fused onto the master, or a dry film or liquid photoresist that is appropriately exposed.

Also, where a plurality of color toners are used to make a full color image, it is possible to use only three colors, not including black, to make the full color image and to create a black color from the three colors employed. This is appropriate where black is not utilized for highlighting.

Further, although the first intermediate transfer surface has been described previously as being conductive, it is to be understood that it can also be a nonconductive material, such as a Mylar ® polyester film or an aluminized Mylar ® polyester film which has aluminum on only one surface. In this instance the Mylar ® polyester film is charged by a conventional corona charging element that is incorporated into the printing apparatus 10. The surface is then wicked with the non-polar insulating branched aliphatic hydrocarbon as previously described and the liquid toner developed image on the photosensitive or photoconductive surface is electrostatically transferred across the liquid-filled gap by bringing the two liquid layers together, but leaving a definite gap between the first intermediate transfer surface and the photosensitive or photoconductive surface.

Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety in pertinent part.

Having thus described the invention, what is claimed is:

1. Apparatus for transferring a liquid toner color image comprising in combination:

(a) a photosensitive surface mounted adjacent imagewise exposing means for exposing an image thereon;

(b) charging means cooperative with the photosensitive surface to charge the surface on the photosensitive surface;

(c) developing means to develop the charged image with liquid toner;

(d) a first intermediate transfer surface mounted adjacent the photosensitive surface to receive the developed liquid image from the photosensitive surface;

(e) drying means to substantially dry the developed liquid image on the first intermediate transfer surface to form a dry image;

(f) a second intermediate transfer surface contactable with the first intermediate transfer surface, the second intermediate transfer surface having an adhesive or tacky quality effective to remove the dry image from the first intermediate transfer surface;

(g) feeding means effective to feed a final receiving surface to the second intermediate transfer surface; and (h) fusing means effective to contact the dry image to the final receiving surface and fuse the image thereto.

2. The apparatus according to claim 1 wherein the photosensitive surface is photoconductive.

3. The apparatus according to claim 2 further comprising the first intermediate transfer surface being smooth.

4. The apparatus according to claim 3 further comprising the first intermediate transfer surface being conductive.

5. The apparatus according to claim 4 further comprising the conductive first intermediate transfer surface being non-oxidizable.

6. The apparatus according to claim 4 wherein the conductive first intermediate transfer surface is metallic.

7. The apparatus according to claim 6 wherein the conductive first intermediate transfer surface is selected from the group consisting of aluminum, stainless steel or chrome plated steel.

8. The apparatus according to claim 1 wherein there is a gap between the photosensitive surface and the first intermediate transfer surface.

9. The apparatus according to claim 8 wherein the gap between the photosensitive surface and the first intermediate transfer surface is filled with a liquid during transfer.

10. The apparatus according to claim 9 wherein the liquid further comprises a nonpolar insulating solvent.

11. The apparatus according to claim 10 wherein the drying means is an air dryer.

12. The apparatus according to claim 9 wherein the second intermediate transfer surface is dielectric.

13. The apparatus according to claim 12 wherein the second intermediate transfer surface is silicone rubber or fluorosilicone.

14. The apparatus according to claim 13 wherein the feeding means further comprises a plurality of feed rollers between which the final receiving surface passes.

15. The apparatus according to claim 14 wherein the fusing means further comprises a rotatable fusing roller.

16. The apparatus according to claim 15 wherein the fusing roller is coated with silicone or polytetrafluoroethylene.

17. The apparatus according to claim 16 further comprising the fusing roller being heated to provide both heat and pressure during fusing.

18. In an apparatus for transferring a liquid toner color image as a developed liquid image from a photosensitive surface to a final receiving surface, the improvement comprising:

a first intermediate transfer surface adjacent the photosensitive surface to receive the developed liquid image therefrom cooperative with drying means to dry the developed liquid image to a dried image thereon and effective to transfer the dried developed image to a second intermediate transfer surface having an adhesive tacky surface layer to remove and transfer all of the toner and dried image from the first intermediate transfer surface to the final receiving surface, the final receiving surface being cooperative with fusing means to fuse the dried image thereto.

19. The apparatus according to claim 18 wherein the photosensitive surface is photoconductive.

20. The apparatus according to claim 18 further comprising the first intermediate transfer surface being smooth.

21. The apparatus according to claim 20 further comprising the first intermediate transfer surface being conductive.

22. The apparatus according to claim 21 further comprising the first intermediate transfer surface being nonoxidizable.

23. The apparatus according to claim 22 wherein the conductive first intermediate transfer surface is metallic.

24. The apparatus according to claim 23 wherein the conductive first intermediate transfer surface is selected from the group consisting of aluminum, stainless steel or chrome plated steel.

25. The apparatus according to claim 18 wherein there is a gap between the photosensitive surface and the first intermediate transfer surface.

26. The apparatus according to claim 25 wherein the gap between the photosensitive surface and the first intermediate transfer surface is filled with a liquid during transfer.

27. The apparatus according to claim 26 wherein the liquid further comprises a nonpolar insulating solvent.

28. The apparatus according to claim 27 wherein the drying mean is an air dryer.

29. The apparatus according to claim 18 wherein the second intermediate transfer surface is dielectric.

30. The apparatus according to claim 29 wherein the second intermediate transfer surface is silicone rubber or fluorosilicone.

31. The apparatus according to claim 30 further comprising a plurality of feed rollers connected to the apparatus adjacent the second intermediate transfer surface between which the final receiving surface passes.

32. The apparatus according to claim 31 wherein the fusing means further comprises a rotatable fusing roller.

33. The apparatus according to claim 32 wherein the fusing roller is coated with silicone or polytetrafluoroethylene.

34. The apparatus according to claim 33 wherein the fusing roller is heated to provide both heat and pressure during fusing.

35. A method of transferring a liquid toner color image from a photosensitive surface to a final receiving surface comprising the steps of:

(a) creating a charged latent image on the photosensitive surface;

(b) developing the charged latent image with a liquid toner;

(c) applying a transfer voltage to a first intermediate transfer surface and transferring the developed liquid toner image to the first intermediate transfer surface;

(d) drying the developed liquid image on the first intermediate transfer surface to form a substantially dry image;

(e) contact transferring the substantially dry image to a second intermediate transfer surface having an adhesive or tacky surface layer;

(f) feeding the final receiving surface to the second intermediate transfer surface under pressure against the second intermediate transfer surface to transfer the dried image from the second intermediate transfer surface to the final receiving surface; and (g) fusing the dried transferred image to the final receiving surface.

36. The method according to claim 35 wherein steps (a) through (c) are repeated until the full image has been transferred to the first intermediate transfer surface.

37. The method according to claim 35 further comprising forming the charged latent image by the steps of:

(a) charging the photosensitive surface to create a charge thereon; and (b) exposing the photosensitive surface to create an area with a charged latent image thereon.

38. The method according to claim 37 further comprising using a photoconductor as the photosensitive surface.

39. The method according to claim 35 further comprising using a conductive surface as the first intermediate surface.

40. The method according to claim 39 wherein the dry image is maintained at a temperature lower than the toner fusing temperature on the conductive first intermediate transfer surface.

41. The method according to claim 40 wherein the dry image is raised to a temperature at or above the toner fusing temperature on the second intermediate transfer surface by a fusing roller to transfer the image and fuse it to the final receiving surface.

42. The method according to claim 35 further comprising forming the charged latent image by the steps of:

(a) exposing the photosensitive surface to create an area with a charged latent image thereon; and (b) charging the photosensitive surface to create a charge thereon.

43. The method according to claim 42 wherein the dry image is maintained at a temperature lower than the toner fusing temperature on the first intermediate transfer surface.

44. The method according to claim 42 wherein the dry image is raised to a temperature at or above the toner fusing temperature on the second intermediate transfer surface by a fusing roller to transfer the image and fuse it to the final receiving surface.

* * * * *

UNITED STATES PATENT AND TRADEMARK OFFICE

CERTIFICATE OF CORRECTION

PATENT NO. : 5,150,161

DATED : September 22, 1992

INVENTOR(S) : David P. Bujese

It is certified that error appears in the above-identified patent and that said Letters Patent is hereby corrected as shown below:

In column 14, at line 30 after "full" and before "image" please insert --color--.

Signed and Sealed this

Twelfth Day of October, 1993

*Attest:*

*Attesting Officer*

Bruce Lehman

BRUCE LEHMAN

*Commissioner of Patents and Trademarks*